US007503827B2

(12) United States Patent
Alfaro

(10) Patent No.: US 7,503,827 B2
(45) Date of Patent: Mar. 17, 2009

(54) ARTIFICIAL GLASS EYE AND METHODS OF MANUFACTURE THEREFOR

(75) Inventor: Antonio R. Alfaro, Upper Black Eddy, PA (US)

(73) Assignee: Tohickon Corporation, Ottsville, PA (US)

( * ) Notice: Subject to any disclaimer, the term of this patent is extended or adjusted under 35 U.S.C. 154(b) by 36 days.

(21) Appl. No.: 10/817,343

(22) Filed: Apr. 2, 2004

(65) Prior Publication Data

US 2005/0064783 A1 Mar. 24, 2005

Related U.S. Application Data

(60) Provisional application No. 60/459,705, filed on Apr. 2, 2003.

(51) Int. Cl.
*A63H 3/38* (2006.01)

(52) U.S. Cl. ..... 446/389; 446/392

(58) Field of Classification Search ..... 446/385, 446/386, 389, 392

See application file for complete search history.

(56) References Cited

U.S. PATENT DOCUMENTS

| | | | | | |
|---|---|---|---|---|---|
| 3,846,199 | A * | 11/1974 | Capelli | ..... | 156/61 |
| 4,601,673 | A * | 7/1986 | Nasca | ..... | 446/389 |
| 5,735,895 | A * | 4/1998 | Rinehart | ..... | 623/6.56 |
| 2004/0077279 | A1 * | 4/2004 | Lam et al. | ..... | 446/392 |

* cited by examiner

*Primary Examiner*—Kien Nguyen
(74) *Attorney, Agent, or Firm*—Dilworth Paxson LLP; John W. Goldschmidt, Jr.; Philip J. Foret

(57) ABSTRACT

Provided are an artificial glass eye and methods of manufacturing such an artificial glass eye, wherein the methods comprise fusing together at least two pre-formed glass components. The eye is prepared from components including representations of the sclera, pupil, iris and cornea that are designed to fit together to form a realistic artificial glass eye. The components are designed to advantageously avoid trapping air between the components when heated, thereby reducing the possibility of fracture during fusion of the components into the final product. Also provided is a method for preparing a combined iris/pupil combined component to avoid the iris component and the pupil component from moving from their intended positions relative to each other during handling or processing.

3 Claims, 12 Drawing Sheets

| FUSED(in) THICKNESS | ANNEAL TEMP(°F) | ANNEAL TIME(min) | TRANSI-TION RATE |
|---|---|---|---|
| 1/8" | 930 | 30 | 50(°F/min) |
| 3/16" | 915 | 30 | 25(°F/min) |
| 1/4" | 900 | 30 | 13(°F/min) |
| 5/16" | 890 | 45 | 8.8(°F/min) |
| 3/8" | 880 | 45 | 6.0(°F/min) |
| 7/16" | 870 | 60 | 4.5(°F/min) |
| 1/2" | 860 | 90 | 3.4(°F/min) |

FUSED THICKNESS v.s. ANNEAL DATA

ARTIFICIAL GLASS EYE AND METHODS OF MANUFACTURE THEREFOR

CROSS REFERENCE TO RELATED APPLICATIONS

This application claims priority to Provisional Patent Application No. 60/459,705, filed Apr. 2, 2003, which is herein incorporated by reference in its entirety.

FIELD OF THE INVENTION

The present invention relates generally to articles of manufacture and methods for the manufacture of artificial glass eyes used in taxidermy, dolls, sculptures and the like, as well as the eye product made as a result of the manufacturing process.

BACKGROUND OF THE INVENTION

The construction of life-like and realistic manikins, e.g., taxidermy mounts, dolls, stuffed animals, clothing mannequins, artistic sculptures, etc., can be extremely difficult. Every body part must be accurately depicted for the manikin to be acceptable. Yet accurately depicting body parts often requires a high degree of technical expertise in both design and manufacturing.

One area of unique difficulty is artificial glass eyes and the methods of manufacturing the eyes. Artificial glass eye construction requires significant artistic skill, time, anatomical knowledge, and experience to create realistic artificial eyes. Typical artificial glass eyes, such as taxidermic and doll eyes, have a generally hemispherical or aspherical outer surface. The eyes are usually hollow having a convex outer surface and a flat or concave inner surface or back. Markings are typically placed on the concave back of the eye blank to simulate the elements of a real animal or human eye or a fanciful eye. A realistic artificial eye includes the common visual eye elements for each particular application, e.g., type of animal, type of doll, teddy bear etc. For example, a typical artificial eye contains sclerotic capsule or base, pupil, iris, and cornea elements. Thus, the artificial eye design and manufacturing process requires that when assembled, the combined components create a realistic artificial eye, and that the elements are able to efficiently and correctly form together during manufacturing or production.

The design and manufacture of realistic artificial eyes is historically slow and tedious, and requires highly trained artists and technicians. Artificial glass eye construction involves a number of interrelated factors, including: the ability to produce a variety of designs, the materials used, the manufacturing processes and the level of skill required to produce anatomically realistic eyes. Accordingly, along with the artistic need to depict realistic eyes, these factors must all be considered in the design of artificial eyes. As described below, current artificial glass eye construction is technically complicated and expensive.

One type of artificial eye construction, known as lampworking, comprises the use of clear or colored glass rods, which are softened in a flame, shaped into an eyepiece with hand molds, and then allowed to cool. In a second step, a skilled artist, using vitreous glass enamels, paints the pupil and iris color by hand onto the back of the eyepiece. The eyepiece is then fired to fuse the color to the glass (see, e.g., U.S. Pat. Nos. 4,637,159 and 5,735,895). Because this process is mostly done by hand, this type of artificial eye construction requires an extremely high level of skilled labor to produce anatomically correct shapes and aesthetically pleasing designs. Additionally, because the color is applied to each eye individually by hand, it is difficult to maintain uniformity in the designs.

Another type of artificial eye construction, clear glass rods are heated and softened and pressed into molds to create a clear glass shell eyepiece. After cooling, the excess material of the rod, exposed outside of the mold, is trimmed and the edges ground to produce a clean shell. The shell is then decorated by hand to depict a specific eye design. Again, this type of artificial eye construction comprises many slow and tedious finishing and decorating steps, and requires a high level of technical expertise.

A more recent type of artificial glass eye construction uses glass plates or disks (see, e.g., U.S. Pat. No. 4,822,397). The glass sheets are printed with the markings and coloring for one or more eye images. The glass plates are then positioned over steel trays, such that the printed eye images are placed over openings in the trays. The openings are of specific sizes for various eye designs. The glass plates are then heated to the softening point of the glass. The heated glass sags through the openings to form the eye shapes with the pre-printed image. Once the glass has cooled, the excess material is trimmed away with cutting and grinding. Because the glass sheets are flat, silk screen printing or decals may be used to create the markings and colorings for the eye images. Consequently, this type of artificial eye construction eliminates the hand painting of the other eye construction methods, thus decreasing the need for highly skilled painters. Additionally, the ability to produce numerous eyes at the same time, and the easier method of shaping the eye blanks, decreases costs and increases the speed of production. However, because the coloring relies on correctly located silk screening or decals and because the glass is merely sagging into an opening, this type of artificial glass eye may not consistently provide anatomically precise eyes, resulting in a great deal of waste.

Thus, until the present invention, there has remained an unmet need in the art for an artificial eye construction method and artificial eye that provides a more precisely colored, polished and anatomically realistic eye without the need for highly trained artists and technicians. In addition, it is desirable that the artificial eye construction provides a consistent product, without increasing costs or production times.

SUMMARY OF THE INVENTION

The present invention provides apparatus, methods and articles of manufacture for accurately and efficiently producing artificial glass eyes used in taxidermy, sculptures, dolls, toy animals, clothing mannequins, or other life-like bodies utilizing artificial eyes. The present invention eliminates the need for highly skilled artists and technical craftsman, thus reducing the costs associated with the production of artificial glass eyes. At the same time, the present invention provides highly detailed and artistically accurate artificial eyes to meet the consumer's desire for an accurate simulation of natural eyes. In a preferred embodiment of the present invention, an artificial glass eye and methods of producing such an artificial eye are provided that comprises at least two preformed glass components fused together to form an accurate simulation of a natural eye.

Also provided is a preferred embodiment, wherein the artificial glass eye comprises one or more preformed glass components that are subsequently fused together. In one preferred embodiment, the artificial glass eye comprises four components: glass base component, pupil component, iris component, and cornea component fused together. The glass base component comprises a recess, wherein the iris and pupil components fit together and are subsequently fused. The cornea component, comprising a pressed glass blank is fit over the glass base component, pupil component and iris component, and the components are fused together to form the artificial eye.

Further provided is another preferred embodiment, wherein the artificial glass eye comprises five components: outer ring component, glass base component, pupil component, iris component, and cornea component fused together. The additional outer ring component is designed so that the glass base component fits within the preformed outer ring component. The glass base component comprises a recess for the iris and pupil component. The cornea component, comprising a pressed glass blank is fit over the combined outer ring component, glass base component, pupil component and iris component, and the components are fused together to form the artificial eye.

Also provided is another preferred embodiment, wherein the artificial glass eye comprises two preformed components: a decorated glass base component and cornea component, which are subsequently fused together. In this embodiment, the decorated glass base component comprises a flat region to contain graphics of the eye. Such graphics include, but are not necessarily limited to, decals such as a screen-printed ceramic temperature decal, a water slide decal or a heat release decal. Alternatively, the graphics of the eye comprise ceramic temperature vitreous enamels printed onto the flat region. The cornea component comprising a pressed glass blank is fit over the decorated base component and fused together to form the artificial eye. The present invention also provides the decorated base component for an artificial eye comprising a pressed glass blank having a flat region onto which the graphics of the eye are placed.

The present invention further provides methods of manufacturing an artificial eye comprising: providing a component alignment tray having one or more holes, wherein the holes are shaped and sized to match a specific eye; placing the component alignment tray onto a carrier tray; loading at least two glass eye components through the one or more component alignment tray holes onto the carrier tray; wherein the eye components are configured and loaded so as to create the artificial eye when combined; removing the alignment tray; heating the loaded carrier tray to fuse the glass eye components; and cooling the fused glass eye. Also provided is a carrier tray made from a refractory material, to which a release agent may be applied.

Alternative methods are also provided, for example in a preferred method the iris and pupil components are lightly fused together into a single iris/pupil component prior to being combined with other components. In a preferred method an iris alignment tray is provided, having one or more holes. The iris alignment tray is placed on top of a carrier tray, and the iris components are then placed into their desired position using the iris alignment tray on the carrier tray. Also provided is a pupil alignment tray, having one or more holes. The pupil alignment tray is placed on top of the iris alignment tray, thereby positioning the pupil component onto the iris component in the desired position. The pupil alignment tray and the iris alignment tray are then removed and the two glass components are lightly fused. Although the manufacturing methods are described herein for an artificial glass eye, the trays and apparatus used therein are designed to produce one or more than one glass eyes at a time, limited only by the number of holes and spaces in the trays, the number of glass eye components available, or the total completed product desired.

In an alternate method of manufacture an artificial glass eye is prepared utilizing a preformed glass base component having a flat area decorated to represent the pupil and iris of an eye; and providing a cornea component, sized and shaped to fit over the specific base component. Using a component alignment tray, having one or more holes, and a carrier tray placed one over the other as above, the decorated base component and the cornea component are loaded into the one or more alignment tray holes to place them into the desired position with respect to one another. The alignment tray is then removed and the loaded carrier tray is heated to fuse the glass eye components. In the alternative, such method further comprises decorating the flat area with a printed ceramic decal or ceramic temperature vitreous enamels.

Therefore, it is an object of the present invention to provide a realistically accurate and reproducible artificial glass eye, and methods of manufacturing such artificial glass eyes that reduce the need for highly skilled artists and highly trained craftsman, thereby decreasing the cost of manufacturing such artificial glass eyes, while at the same time providing a superior product. Additional objects, advantages and novel features of the invention will be set forth in part in the description and figures which follow, all of which are intended to be for illustrative purposes only, and not intended in any way to limit the invention, and in part will become apparent to those skilled in the art on examination of the following, or may be learned by practice of the invention.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s), which are presently preferred. It should be understood, however, that the invention is not limited to the precise arrangements and instrumentalities shown.

DETAILED DESCRIPTION OF PREFERRED EMBODIMENTS

Figure 1:
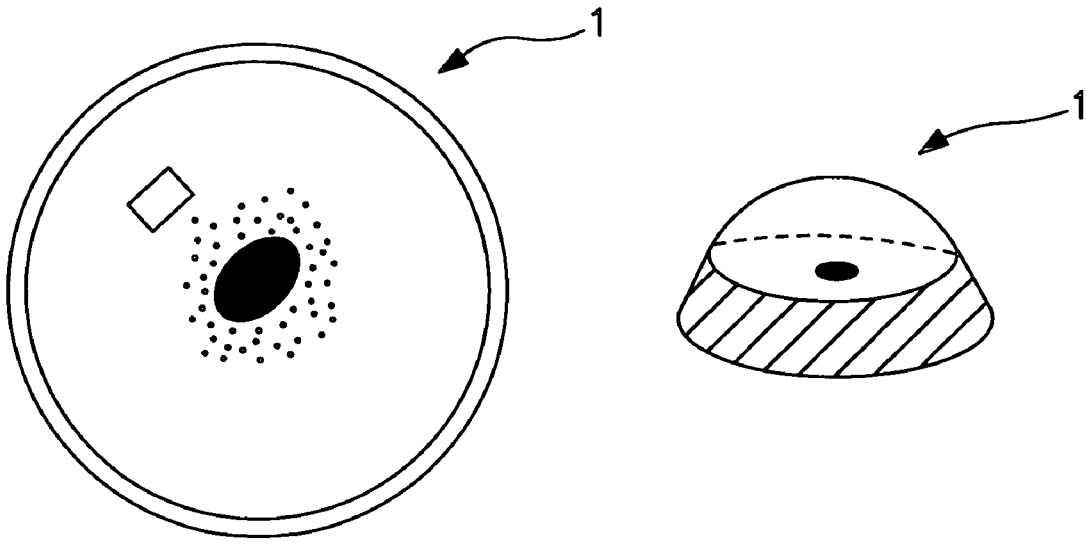
FIG. 1 shows an artificial glass eye of a preferred embodiment of the present invention.

Reference is now made to the accompanying Figures for the purpose of describing, in detail, preferred embodiments of the present invention. Like elements have the same numbers throughout the several views. The detailed description accompanying each Figure is not intended to limit the scope of the claims appended hereto.

Naturally occurring eyes generally have a convex aspheric outer shape with variously colored features or elements. Many internal elements of the eye are not visible and thus need not be simulated in an artificial eye. However, numerous visibly identifiable elements of an eye display either unique shapes or colors that make the eye individually recognizable. As known in the art, visible eye elements of different species vary by shape, color and size. Species, as used herein, comprises any class or group of human, animal, bird, fish, reptile, amphibian, mammal, doll, or other type manikin wherein an artificial eye is used. For example, a deer has a differently shaped and differently colored visible eye than a snake or a fish. Therefore, an artificial eye embodiment for a deer would have a different shape and color than an embodiment for a snake or a fish. However, each species comprises several visible and individually recognizable elements. When producing artificial eyes, these features or elements of the eye must be artistically and accurately represented to properly simulate the natural eye of that species. The individual elements, determined by the size and the specific characteristics of the individual species being reproduced, must be properly depicted or simulated to produce the realism desired.

Because there are so many variations in eye shapes, colors and sizes, the techniques used in the production of artificial eyes must accommodate a vast number of unique specimens. For instance, the pupil appears round in some animals, and oblong, elliptical or slits in others. Moreover, although the sclera is often white, the color of the iris varies widely among species. Furthermore, in some animals, the sclera of the eye is not white, and therefore the artificial glass eye sclera color will also vary. Additionally, consumers demand artificial eyes that are a substantially accurate simulation of natural eyes. Consequently, the production of artificial eyes has become highly technical. Current production methods use highly trained artists and craftsmen to manually paint graphics of the individual eye features or elements onto blank glass shapes. These methods require a great attention to detail along with a substantial knowledge of the eyes of different species. Accordingly, the current production of artificial eyes requires highly trained artists and technicians.

The artistic and technical skill level required to provide realistic artificial eyes continuously drives the cost of production higher. The present invention provides artificial eyes, and methods of producing artificial eyes, that are colored, polished, and anatomically more precise than the previously commercially produced artificial eyes, but without the need for highly trained artists and technicians.

The present invention provides artificial glass eyes and methods of producing same, whereby at least two eye components are produced separately and fused together to form the artificial glass eyes. Because the separate components, depicting the individual elements of the eye, do not require manually painting the elements of the eye onto a pre-formed blank, the need for highly skilled artists is eliminated. Thus, the present invention eliminates the expense of highly skilled artists and thus decreases the cost of producing artificial eyes. At the same time, in a preferred embodiment, the separate components are produced with the attention to detail that realistically simulates a natural eye. Because the components are produced separately or pre-formed and then fused together, the present invention differs from the current lampworking method or artificial eye construction. Moreover, in an alternative preferred embodiment of the present invention, the artificial eye comprises decals in an infinite variety of colors and designs to add high resolution details.

FIG. 1 depicts a preferred embodiment of artificial glass eye 1. Artificial glass eye 1 comprises at least two preformed components which are designed to be assembled together to produce an artificial eye that realistically simulates a natural eye. After each component is separately produced, the components are combined, in the appropriate order, and heated to a temperature required to fuse the components together. The fused artificial glass eye is then cooled to anneal the glass components, thereby producing the artificial glass eye 1.

Figure 2:
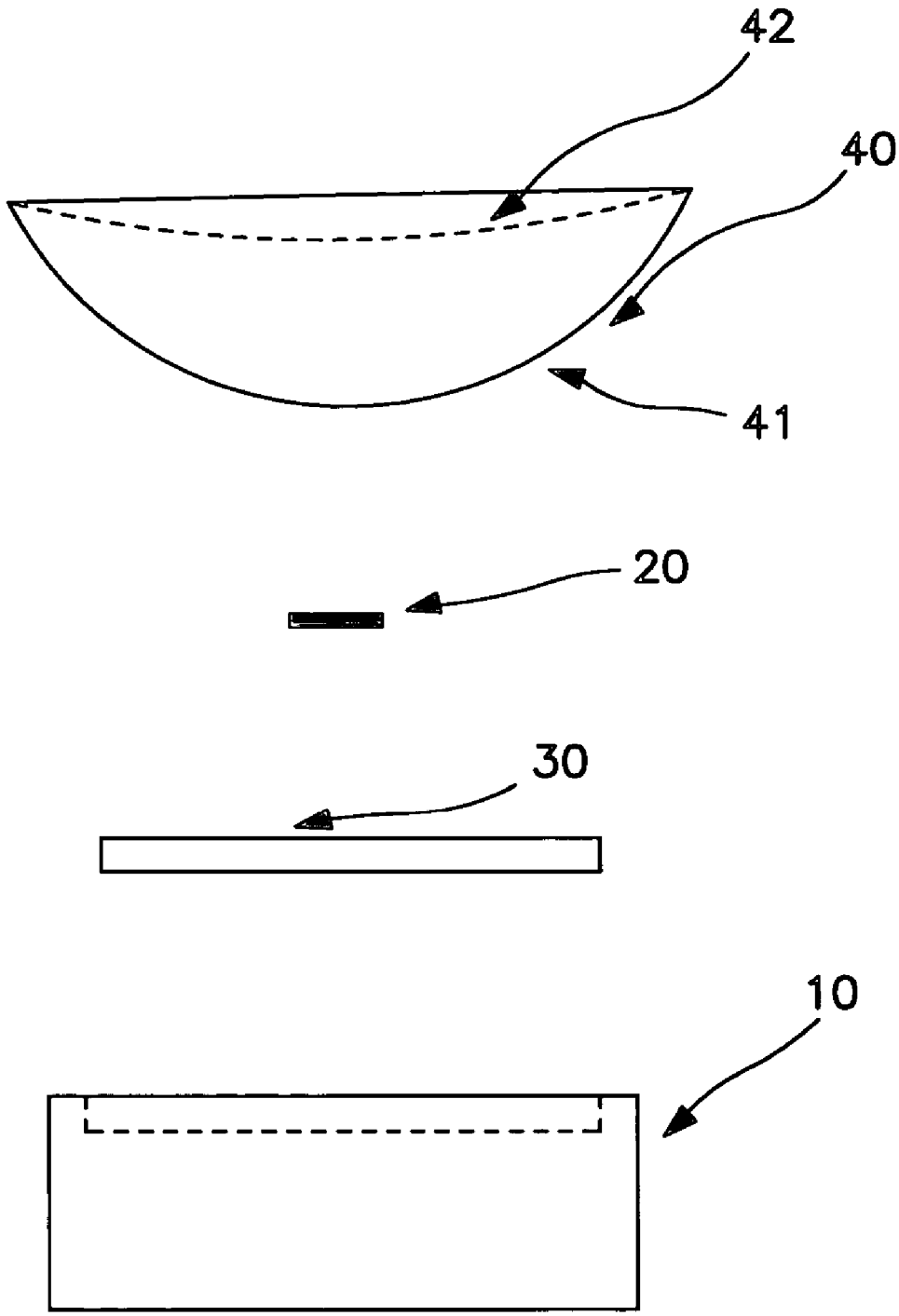
FIG. 2 shows an expanded view of a preferred embodiment of an artificial eye.

The visible elements of an eye, located in the front of the eye, provide the variations that uniquely identify a particular species. Depending on the species, the visible or recognizable elements of an eye generally include elements, such as sclera, iris, pupil and cornea. FIG. 2 shows an expanded view of a preferred embodiment of artificial glass eye 1, wherein the four elements are represented by four separate components comprising: glass base component 10, pupil component 20, iris component 30, and cornea component 40. The components are fitted together and fused to form artificial glass eye 1.

In most natural eyes, the base portion of the eyeball is the sclera. The sclera is an opaque dense outer coat enclosing the entire eyeball except the part of the eyeball covered by the cornea. The sclera or sclerotic capsule may vary in size, shape and color for each species. A large portion of the sclera is fitted into the eye cavity and thus not externally visible. In a preferred embodiment, glass base component 10 comprises a glass base that in effect forms the sclerotic capsule of the eye.

Figure 3:
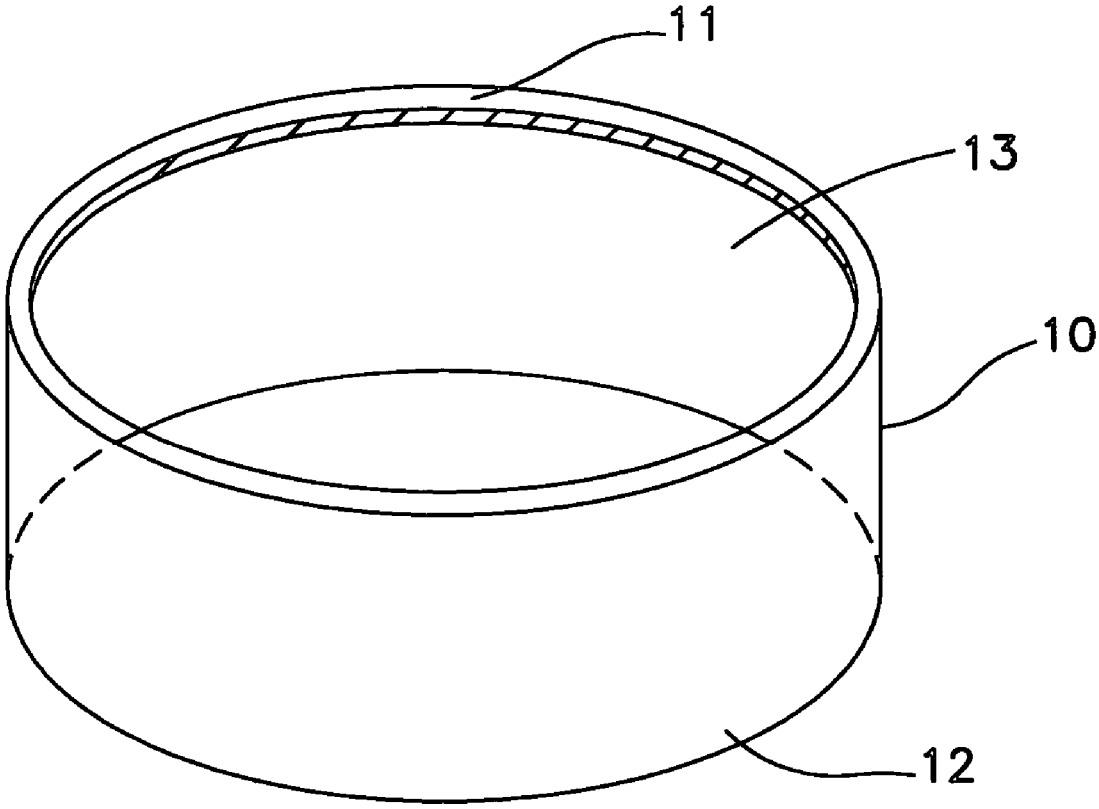
FIG. 3 shows an isometric view of a base component of the embodiment of FIG. 2.

FIG. 3 shows glass base component 10 of the preferred embodiment shown in FIG. 2. Base component 10 comprises a generally solid, preformed cylindrical shape having a top end 11 and bottom end 12 and wherein there is a recess or depression 13 located generally in the center of top end 11. In a preferred embodiment, base component 10, is a pre-formed powder-pressed glass base, when in use in an artificial eye is constructed to represent the visible portion of the sclera of the eye. Base component 10 may be formed by any method known to one skilled in the art. For example, in a preferred embodiment, base component 10 is made by adding inorganic oxides, fluxes, and organic binders to finely powdered glass particles. The glass particles are then pressed in a pellet press to the shape and size desired for the specific eye being simulated. The particles are then heated to sinter the particles, which drives off the organic binders and slightly fuses the glass particles to help them retain their shape. Base component 10 is produced in the desired shape, size and color to represent the sclerotic capsule being simulated. For example, base component 10 may be formed from white, black, or brown glass or other colors as needed to reproduce the natural eye. Moreover, glass base component 10 may be further iridized with micaceous pigments to produce the lusters and colors needed to simulate the unique look of the sclera of fish and reptiles.

So that the separate components properly fit together when combined, base component 10 is produced with a recess to accommodate other components of artificial eye 1. As shown in a preferred embodiment depicted on FIG. 3, base component 10 contains iris recess 13 to hold iris component 30. Iris recess 13, as shown in FIG. 3, forms a recess in base component 10 in which iris component 30 rests. The size and shape of iris recess 13 is designed to accommodate the size and shape of the specific iris component 30. Typically, the iris is generally circular in shape so that, in the preferred embodiment of FIG. 2, iris recess 13 is a generally circular recess. Additionally, the iris is generally centered within the eye, so that recess 13 is generally centered within top end 11 of base component 10. However, as known in the art, like the pupil, although the iris is often centered in the eye when the eye is depicted looking straight forward, the iris may be located off center for an artificial eye depicting an eye looking in another direction. Thus, the location of iris recess 13 in glass base component 10 depends on the orientation of artificial eye 1.

Turning to pupil component 20 as shown in the preferred embodiment of FIG. 2, pupil component 20 comprises a pressed disk of colored glass. The color, size and shape of pupil component 20 correspond to the specific species being simulated. For example, the pupil for a bird eye will usually be round, but the pupil for a deer eye will be oblong in shape and the pupil for a cat eye will be a slit shape. In the preferred embodiment shown in FIG. 2, pupil component 20 comprises a pellet pressed disk of black glass or a bead of vitrified black glass. However, along with varying the shape and color to represent a specific species, one skilled in the art would be aware of a variety of materials that may be used for pupil component 20.

Figure 4:
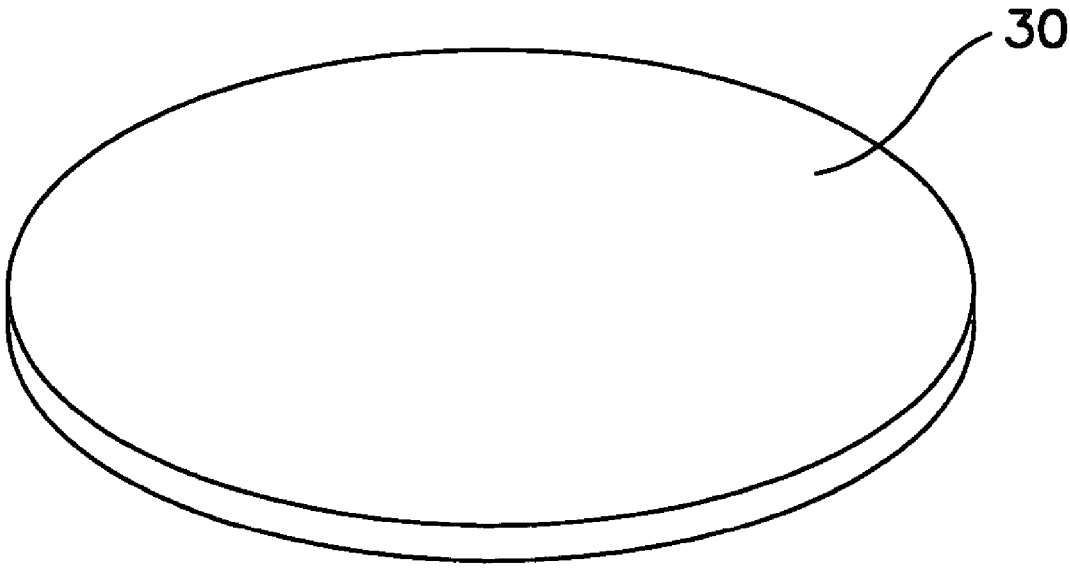
FIG. 4 shows an isometric view of an iris component of the embodiment of FIG. 2.

FIG. 4 shows iris component 30 of the preferred embodiment shown in FIG. 2. Iris component 30 comprises a thin disk, typically circular in shape, although other shapes could be selected depending upon the actual shape that the practitioner elects to have for the iris in the finished artificial glass eye. The iris component disk is of sufficient thickness to provide the necessary color to the iris portion of the finished product, but the disk is not so thick as to alter the fusion capabilities of the glass components or to cause the components not to fit together into a finished product that mimics the natural eye or one of fanciful design. To simulate the variety of colors and details found in natural eyes, iris component 30 is produced in an assortment of colors or any combination thereof. For example, an iris of a single color may be produced from a single colored glass. Multicolored irises may be produced by applying a dusting of finely powdered glass of other colors onto the disk. Alternatively, a combination of powdered glasses may be formed together to produce the color variations for the specific iris.

A fourth component of the preferred embodiment shown in FIG. 2, is cornea component 40. In a typical eye, the cornea is a transparent covering over the iris and pupil, which lets light into the interior of the eye. The cornea component of the eye is a generally transparent convex element that forms the outer surface of the visible portion of the eyeball.

As shown in FIG. 2, in a preferred embodiment, cornea component 40 initially has a preferred convex inner surface 41 and concave outer surface 42. Although one normally would consider an outer surface to be convex, and an inner surface to be concave, the normal usage is reversed herein to reflect the assembly process of forming the artificial eye. In this case, "inner" refers to that portion of a component that will be placed into contact with the next component. Consequently, since the surface of the cornea component 40 placed in contact with the remaining components is the convex surface, it is referred to herein as convex "inner" surface 41. Conversely, in this embodiment, the concave surface of the cornea component 40 actually forms the outer surface of the finished artificial glass eye, therefore it is referred to as the concave "outer" surface 42, meaning that ultimately that surface is the outside surface of the finished product.

This apparent anomaly is necessary to prevent air from being captured in the finished product as will be described, and during the fusing process the exposed edges of the glass components become rounded when the glasses reach their softening point. As a result, cornea component 40 may be made in a variety of shapes, such as round, convex, conical or the like, so long as the shape of cornea component 40 permits it to fit with the other components as described without trapping air. Likewise, rather than concave, the outer surface 42 of cornea component 20 could be relatively flat, so long as when heated to softening, the outer surface 42 rounds out the outer surface of the finished glass eye as desired.

To produce the desired clarity of the cornea, a pressed vitreous part is used since a pre-formed part may not fire to absolute clarity. In the preferred embodiment, cornea component 40 is produced by pressing a transparent glass rod. Molds used to form cornea component 40 are manufactured for each specific artificial eye specimen. The molds used in the preferred embodiment are tooled steel, however, one skilled in the art would be aware of alternate material and methods for fabricating the molds. The molds are placed in either a hand press or mechanical press. The glass rod is softened in a flame and pressed between the molds. The excess glass from outside the mold or along seam lines is trimmed from cornea component 40, for example, by grinding with diamond wheels, tumbling in a gemstone tumbler or an alternate means known to one skilled in the art of polishing glass.

Cornea component 40 is designed and sized so that it is fitted over the outer-facing surfaces of iris component 30 and pupil component 20, thereby representing the cornea of a natural eye. In a preferred embodiment, cornea component 40 is placed on pupil component 20 and iris component 30 such that the convex inner surface 41 of cornea component 40 contacts pupil component 20 so that no air is trapped between the components as the glass softens during fusing and the edges of cornea component 40 are gradually pulled downward by gravity to cover the outer-facing surfaces of the iris and pupil components, whether they have been previously lightly fused together or not.

In alternative embodiments other shapes may be used for cornea component 40, so long as cornea component 40 first contacts the other components at or near the center or apex of the convex surface, thereby preventing air from being trapped between the components inside the artificial eye 1. Trapped air is particularly problematic during heating the glass to fuse the components because the expanding gas could cause the eye to fracture. Consequently, it is important that the components are designed as described, so that when fit and fused together, trapped air is avoided.

In the alternative, a cylindrical or cone shaped cornea component 40 may be used in place of the cornea component 40 shown in FIG. 2 to achieve the same effect. The size and shape of cornea component 40 allow it to mold around the other components as the glass softens when heated. The amount of glass used, and temperature and time of heating determine the shape of cornea component 40 and thus the shape of artificial eye 1 after fusing. One skilled in the art would know of many alternative shapes that may be used for cornea component 40. Similarly, one skilled in the art of manufacturing such glass articles would know suitable temperatures and times for heating to allow cornea component 40 to properly form around the other components when heated.

In the press-molded technique used to fabricate cornea component 40, a soft glass is preferred. Examples of suitable types of glass include soda-lime glasses and lead/antimony glass. In the preferred embodiment of FIG. 2, cornea component 40 is made from soda-lime glass, however, one skilled in the art would be aware of other glasses that would be suitable for cornea component 40.

In a preferred embodiment, base component 10, pupil component 20, iris component 30 and cornea component 40 are then fused together to form artificial eye 1. In order for the components to properly fuse together, the glass material of each component will have the same linear coefficient of expansion. In fact, the same glass may be used in the production of the various components. For instance, in a preferred embodiment, the glass shavings produced during the fabrication and finishing of cornea component 40 may be used in the fabrication of glass base component 10. The glass particle shavings are ground into finely powdered glass that is then used to fabricate the pre-formed, powder-pressed components, such as glass base component 10. In a preferred embodiment, the finely powdered glass comprises a powder of 165 microns or less. For example, the specifications for a typical soda-lime glass used in a preferred embodiment are shown in Table 1.

TABLE 1

| | |
|---|---|
| Type of glass | Type II (R-6) |
| Color | Natural white |
| Raw material mesh size | Less than 165 mesh |
| Coefficient of expansion | $93 \times 10^{-7}$ cm/cm/° C. |
| Coefficient of thermal contraction | $113 \times 10^{-7}$ cm/cm/° C. |
| Working point | 985° C. |
| Softening point | 700° C. |
| Annealing point | 525° C. |
| Strain point | 486° C. |
| Density | 2.53 theoretical g/cc |
| Volume resistivity (ohm-cm) | $LOG_{10}$ at 350° C.: 5.2<br>$LOG_{10}$ at 250° C.: 6.6 |
| Dielectric constant (25° C., 1 Mhz) | 7.2 |
| Dielectric loss (25° C., 1 Mhz) | 6.1 |

Figure 5:
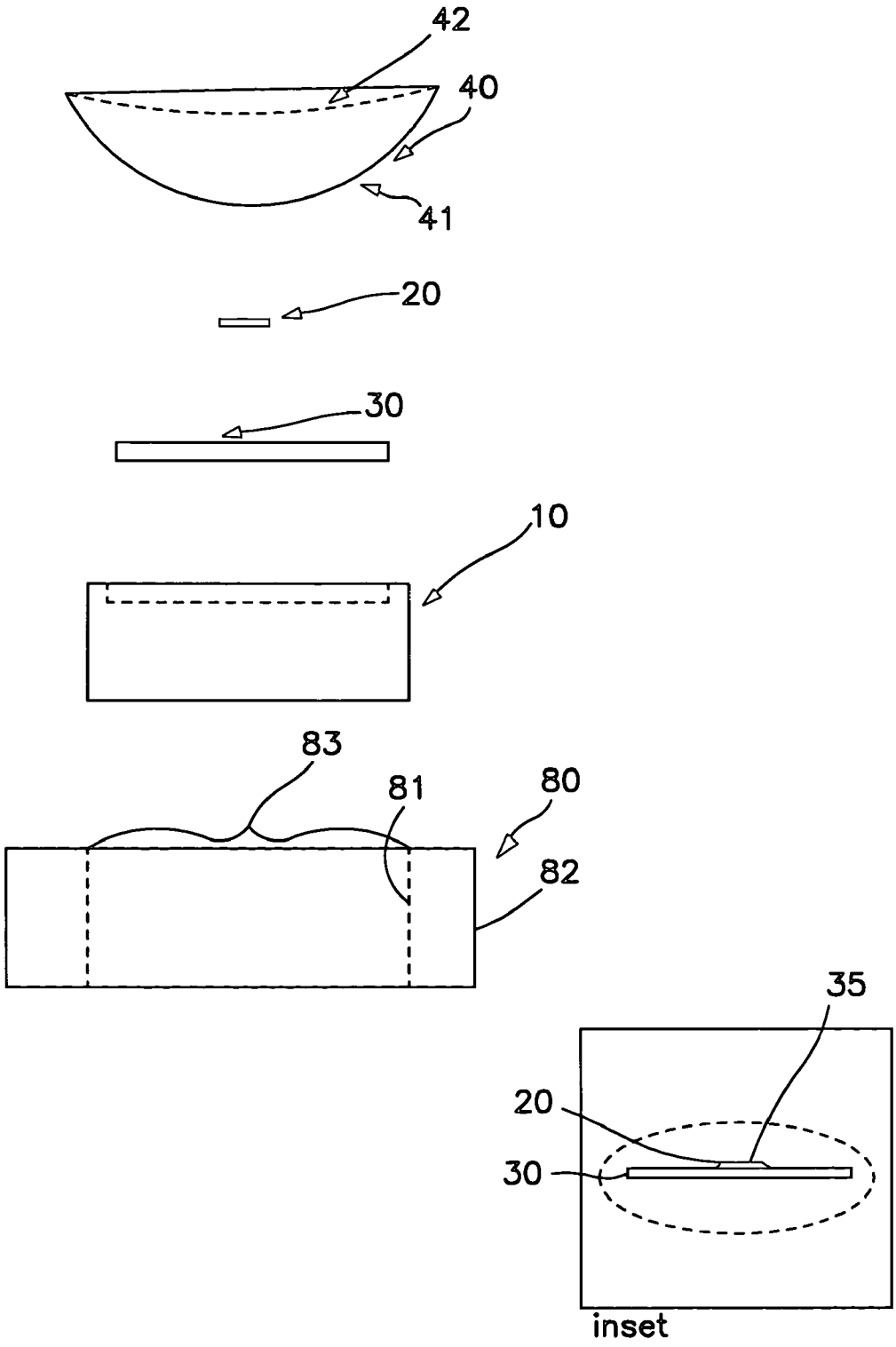
FIG. 5 shows an expanded view of another preferred embodiment of an artificial eye.

FIG. 5 shows an expanded view of another preferred embodiment of artificial glass eye 1, wherein the four elements are represented by five separate components comprising: glass base component 10, pupil component 20, iris component 30, and cornea component 40 and outer ring component 80. The components are fitted together and fused to form artificial glass eye 1. The pre-formed outer ring component 80 comprises a generally hollow cylindrical shape having an inner surface 81 and an outer surface 82 as shown on FIG. 6. Within inner surface 81 is an area encompassing the full diameter of the inside of the outer ring component, and the thickness or depth thereof, referred to herein as inner area 83. Outer ring component 80 is shaped and sized to match a specific base component 10, meaning that although preferably circular in shape, it may also take on non-circular shapes to match the other components. In a preferred embodiment, base component 10 fits inside of and fills inner area 83 of outer ring 80. As exemplified, outer ring component 80 comprises a pre-formed powder-pressed glass base suitable for containing the selected base component 10 fitted within it. Similar to the material of base component 10 as described above, one skilled in the art would know of numerous suitable alternative materials for outer ring 80.

Figure 6:
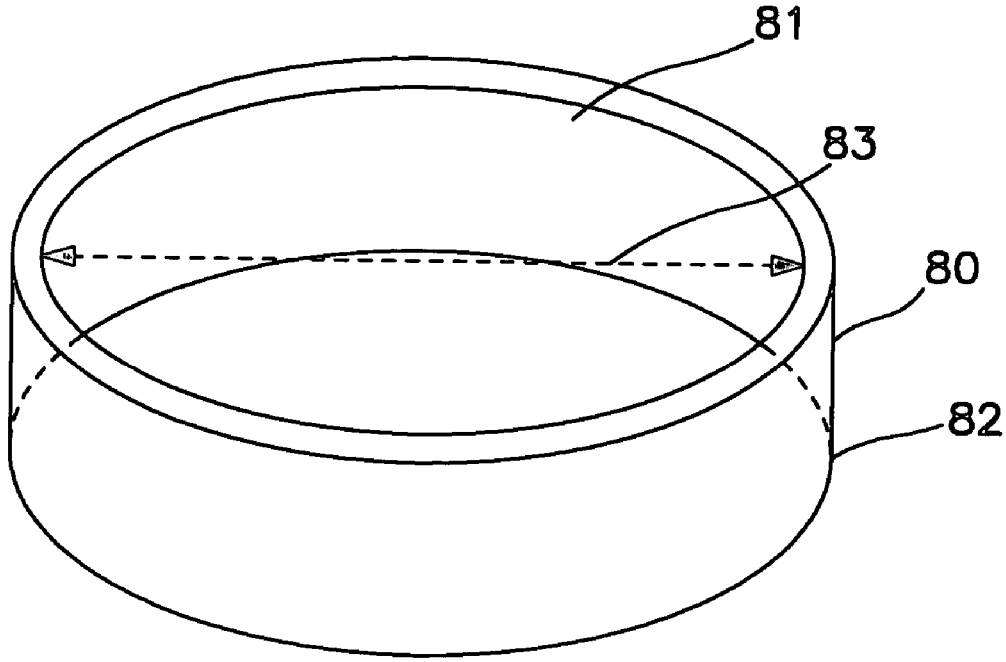
FIG. 6 shows an isometric view of a base component of the embodiment of FIG. 5.

As shown in a preferred embodiment depicted on FIG. 6, pre-formed outer ring component 80 comprises an inner area 83 within its inner surface 81, which is designed to accommodate the size and shape of the base component 10. In a preferred embodiment, glass base component 10 fits neatly within the inner surfaces 81 of outer ring component 80, filling inner area 83, and creating a completed, solid cylinder made from the two glass components.

In order to produce the artificial glass eye of FIG. 1, the components described above are assembled together as described and heated to the fusing point of the glass to bond the individual components together into the finished product. The assembled components are subjected to the fusing point temperature for a specific period of time, and then the assembly is cooled at a specific rate to properly anneal the glass. One skilled in the art would understand the temperature(s) needed to fuse the glass components, and the period of time at the fusing point that would be sufficient to effect the necessary fusion of the components, as well as the specific rate of cooling that would properly anneal the glass components to produce the finished artificial glass eye.

Figure 7:
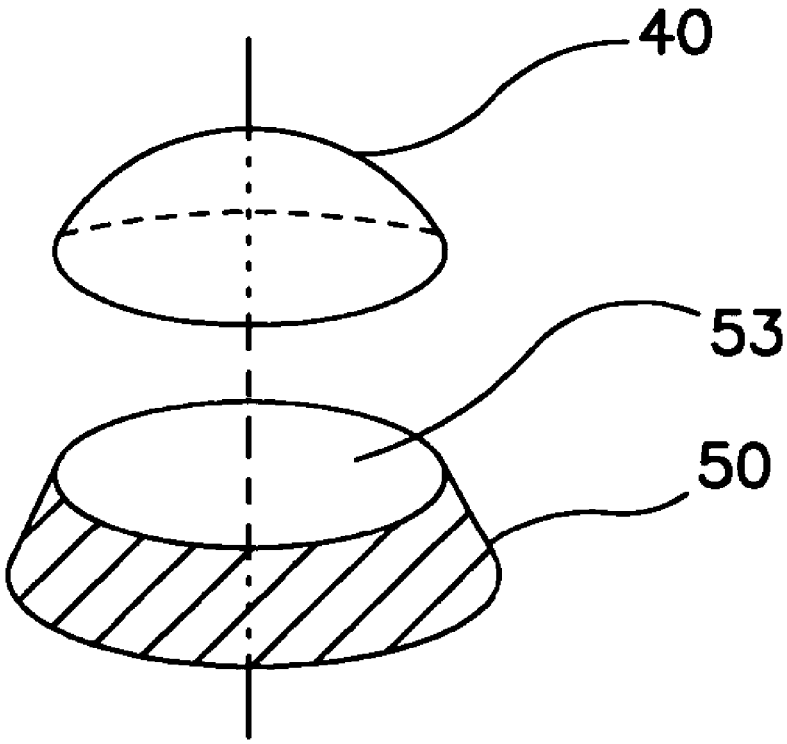
FIG. 7 shows an expanded view of another preferred embodiment of an artificial eye.

Turning to FIG. 7, another preferred embodiment of the artificial glass eye is illustrated which comprises two components: decorated base component 50 and cornea component 40, that are fused together to form artificial eye 1. The artificial eye embodiment shown in FIG. 5 also provides a highly detailed simulation of the natural eye without the need for costly highly trained artists and technicians. In fact, although the preferred embodiment of the artificial eye shown in FIG. 7 comprises fewer components, this embodiment provides the same high level of detail to accurately simulate a natural eye and may even require less technical expertise to produce, as compared with alternative methods.

Figure 8:
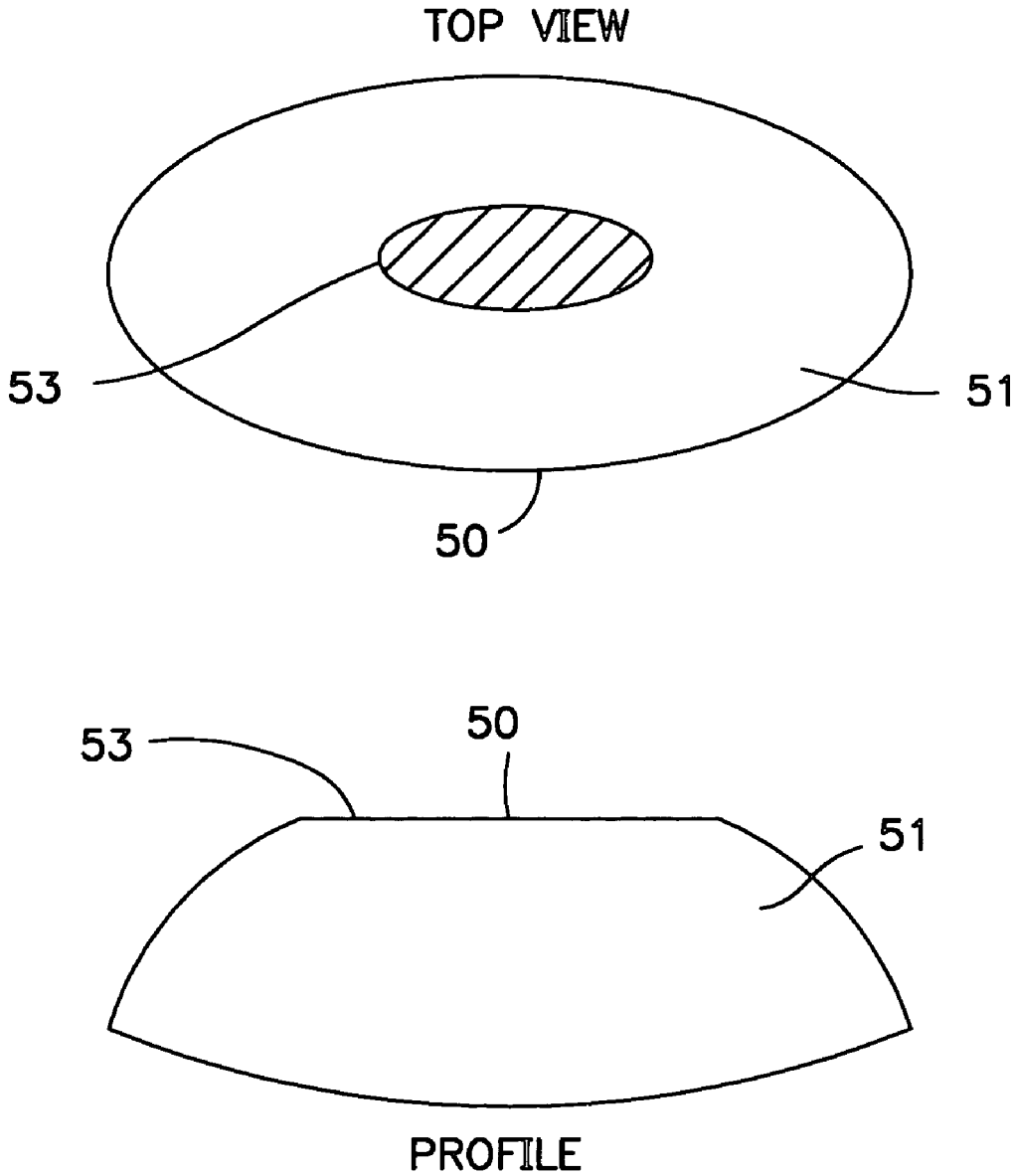
FIG. 8 shows a top and profile view of a base component of the embodiment of FIG. 7.

FIG. 8 shows decorated base component 50 of the preferred embodiment shown in FIG. 7. Decorated base component 50 comprises a generally hemispheric, pressed glass blank having a convex outer surface 51 and an inner face 52. Located on convex outer surface 51 is flat area 53, which is usually, but not always, centered thereon, depending on the appearance desired in the finished product. The size and shape of decorated base component 50, and corresponding flat area 53, depend on the individual characteristics of the specific eye being simulated. Base component 50 represents the sclera of the eye, and accordingly, is produced in various sizes and colors to depict the sclera for each species. Decorations are applied to decorated base component 50 to depict the pupil and iris of the eye. In the preferred embodiment shown in FIG. 8, the decorations, comprising graphics of the eye, are applied to flat area 53. Accordingly, flat area 53 is sized so that decorated base component 50, and a decoration applied to flat area 53, accurately depict the specific eye to be simulated.

Figure 9:
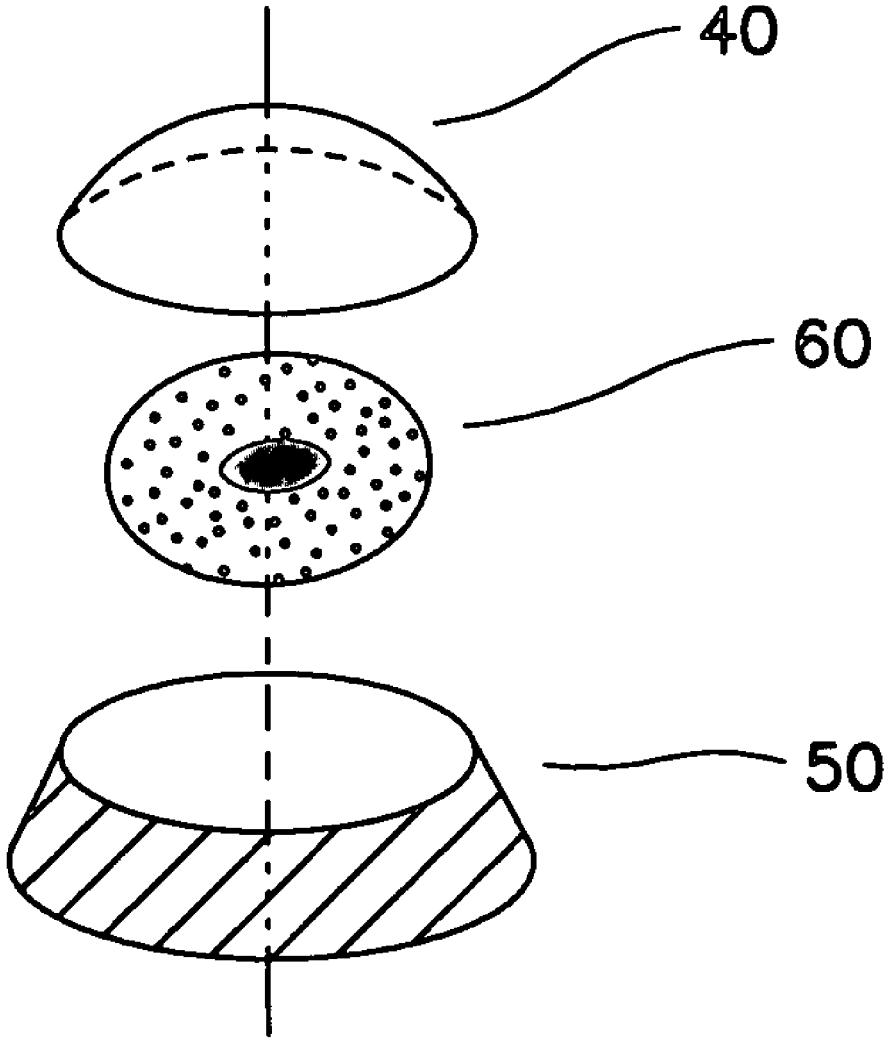
FIG. 9 shows an expanded view of another preferred embodiment of an artificial eye.

In the preferred embodiment shown in FIG. 9, the graphics of the eye comprise decal 60. Decal 60 is printed with the graphics of the pupil and iris of the eye. As known in the art, the graphics comprise high-resolution details printed from the desired artwork for each species. The graphics are printed on decal 60 by a method known to those skilled in the art. For example, in the preferred embodiment, the graphics are screen printed on decal 60. Decal 60 may, however, be selected from any suitable decal that will withstand the heat cycles of the glass fusion process. Accordingly decal 60 can be a water slide decal, a heat release decal, or any other type of decal as know to those skilled in the art that are suitable for the intended purpose. The size of the decal is determined to fit within the area to be decorated on glass base component 50.

Alternatively, in another preferred embodiment as shown on FIG. 7, the graphics are applied directly onto flat area 53. For example, in a preferred embodiment, the graphics are printed onto flat area 53 with ceramic temperature vitreous enamels. As exemplified, the graphics are pad printed onto flat area 53, but one skilled in the art would be familiar with alternate printing methods and/or materials that would be suitable for accurately printing such graphics.

As shown on FIGS. 7 and 9, cornea component 40 is fitted over convex outer surface 51 of decorated base component 50 containing flat area 53 to produce artificial eye 1. Like the embodiment shown in FIG. 2, cornea component 40 comprises a pressed glass blank. The size and shape of cornea component 40 is matched to decorated base component 60 so that the parts are fused together to form artificial eye 1.

Figure 10:
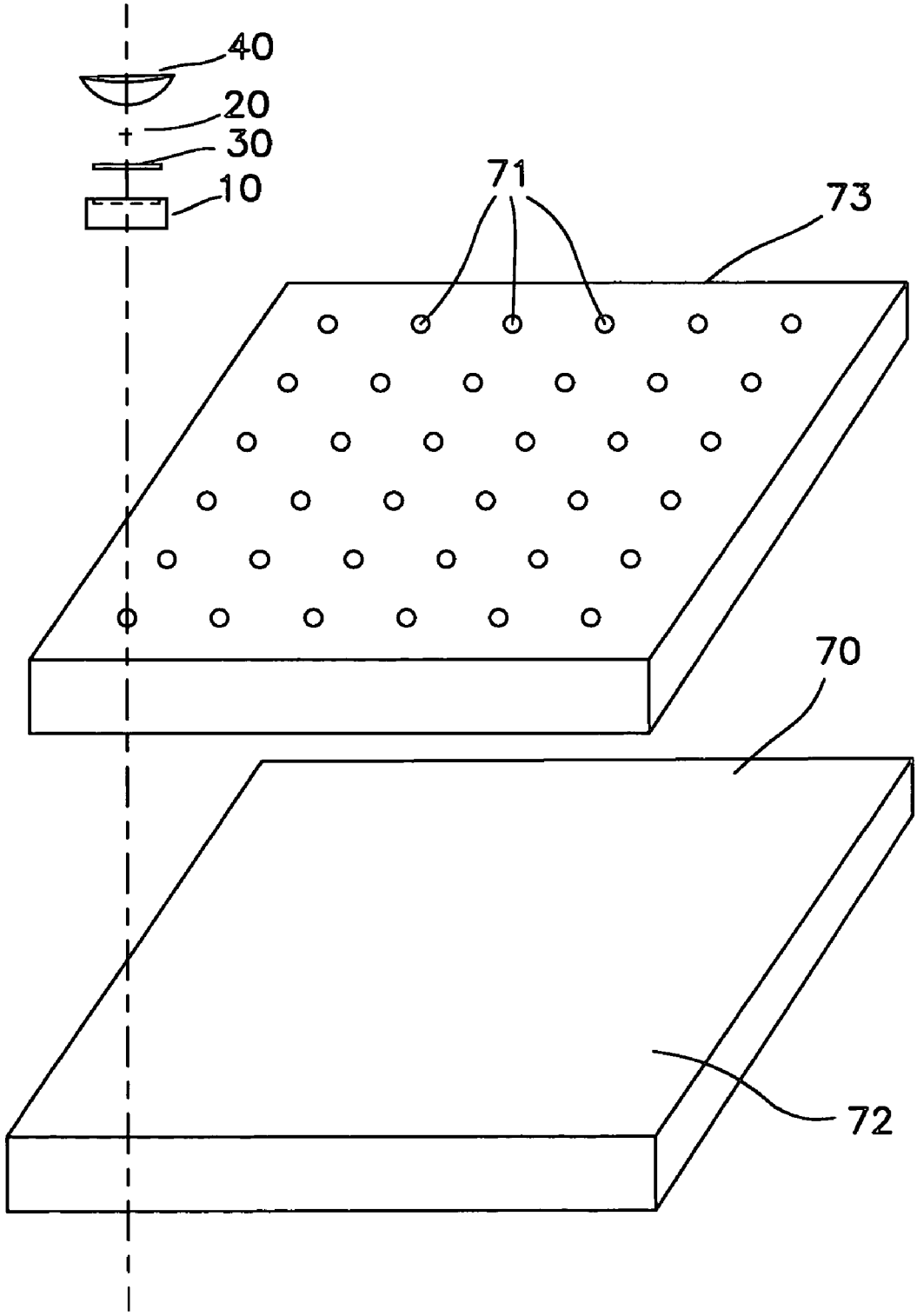
FIG. 10 shows an expanded view of an apparatus for manufacturing the present artificial eye.

Turning to FIG. 10, the present invention also provides methods of manufacturing artificial glass eye 1. As shown in FIG. 10, a preferred method first includes providing carrier tray 70. Carrier tray 70 is made from a refractory material. For example, satisfactory materials include mullite, corderite, ceramic fiber mat or board, stainless steel, carbon or graphite, however, one skilled in the art would know of additional materials that could be used for fabricating carrier tray 70.

A further consideration for the selection of the material for carrier tray 70 is the ability to release the fused glass specimens from carrier tray 70 after the tray is heated. In a preferred embodiment, carbon offers an adequate release of the fused glass specimens, however, other materials may have applied thereon, or require the application of, a coating of a release agent or kiln wash 72 to carrier tray 70 in order to prevent the hot glass from sticking or tacking to carrier tray 70. Coating 72 comprises, without limitation, calcium or magnesium carbonate and kaolin clay or a material as known to one skilled in the art.

In a preferred embodiment, coating 72 is mixed with water and alcohol and either evenly painted or sprayed over carrier tray 70, however, one skilled in the art would be aware of alternative methods for applying coating 72 to carrier tray 70. Additionally, as would be known to one skilled in the art, if carbon material is selected for carrier tray 70, the belt furnace or kiln must be able to sustain an atmosphere of inert gas, such as nitrogen, in order to prevent oxidation of the carbon during the glass fusion process.

Once carrier tray 70 is prepared, alignment tray 73 is positioned directly on top of carrier tray 70. Alignment tray 73 comprises one or more holes 71 for the positioning of components onto carrier tray 70. Holes 71 in alignment tray 73 are shaped and sized to accommodate the components of a specific eye 1. The components of an eye are then loaded into one of the one or more holes 71 located in alignment tray 73. If more than one eye is being produced at the same time, more than one hole would be used, so that one eye is produced per hole used, but the number of eyes being produced simultaneously is limited only by the number of holes and/or number of components available, or by the needs of the practitioner.

The components are loaded in a sequence, such that the components are combined to create artificial eye 1, wherein cornea component 40 fits over the other combined components. For example, in the preferred embodiment shown in FIG. 2, base component 10 is first placed in hole 71. Accordingly, holes 71 in alignment tray 73 are shaped and sized to correspond to the specific base component 10 for the specific eye 1. Iris component 30 and pupil component 20 are then placed together in iris recess 13 of base component 10. Finally, cornea component 40 fits over the other components.

Similarly, in another preferred method of the present invention, the five components as shown in FIG. 5 are loaded into alignment tray 73, wherein holes 71 are sized and shaped to accommodate outer ring component 80. The components of the eye are then loaded into one or more holes 71 located in alignment tray 73. The components are loaded in a sequence such that the components are combined to create artificial eye 1 with cornea component 40 fit over the other combined components. As shown in FIG. 5, base component 10 fits inside of inner area 83 within the inner surface 81 of outer ring component 80. Iris component 30 and pupil component 20 are then placed in iris recess 13 within base component 10. Finally, cornea component 40 fits over the iris and pupil components in conjunction with the base component.

In alternative methods of the present invention, the alternative embodiments of artificial eye 1 having components, such as shown in FIGS. 7 and 9, are loaded into alignment tray 73. As described above, holes 71 are shaped and sized to accommodate specific base component 50 for each specific eye 1. As one skilled in the art would know, in alternative methods, alignment tray 73 with one or more holes 71 may be used to simultaneously align the specific components for any number of artificial eyes 1, or may be reused in the production of additional glass eyes in accordance with the methods of the present invention.

Figure 12:
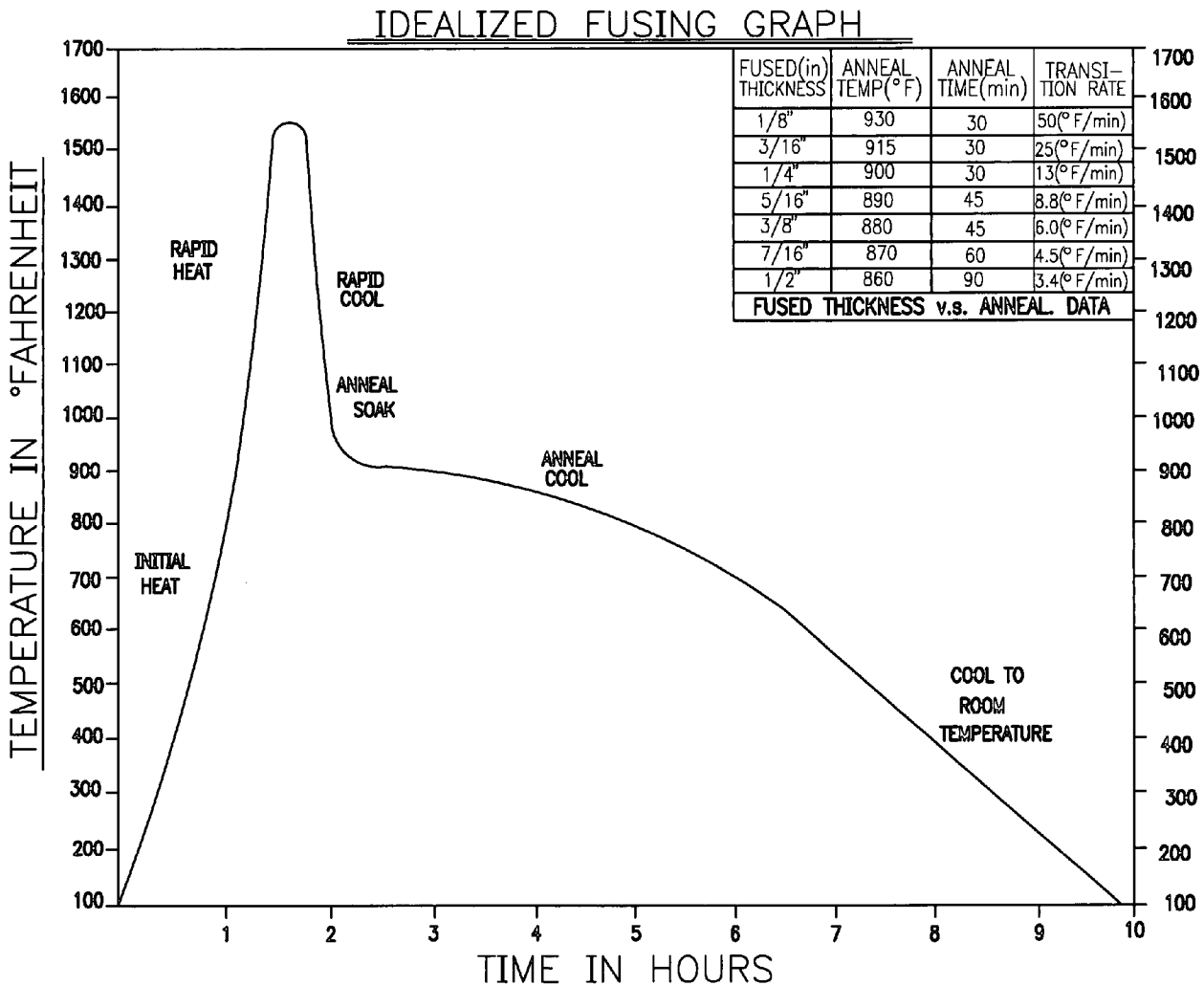
FIG. 12 graphically displays optimal cycle of temperature and time for fusing the components of a preferred embodiment of the artificial glass eye.

After the components are loaded into hole 71, alignment tray 73 is carefully removed so that the eye components do not shift or misalign. Carrier tray 70 is then placed in a kiln or on the belt of a belt furnace. As known to those skilled in the art, the kiln or belt furnace must be properly configured for the production of glass eyes embodiments. The glass components are heated to the fusion point, and the temperature is maintained for a specific period of time. The temperature is then reduced at a controlled rate, cooling the resulting product, and causing the glass components to properly anneal. For example, in a preferred embodiment, using soda-lime glass as shown in Table 1, the heating cycle is shown in FIG. 12. As shown, the typical heating cycle for soda-lime glass comprises a moderately fast ramp up to the fusing point of the glass—ambient temperature to 1500° F. in 20 minutes. The heating cycle then includes a rapid temperature decrease to the annealing point of 1100° F. Lastly, the heating cycle includes a gradual cool down to ambient temperature. Of course, as one skilled in the glass arts would know, the heating cycle will vary depending on the glass used. After cooling, the completed artificial eye 1 is removed from carrier tray 70.

In another preferred method, pupil component 20 and iris component 30 are lightly fused together prior to loading into alignment tray 73, such that the combination of the fused pupil component 20 and iris component 30 is referred to herein simply as "iris/pupil" component. This technique provides more control over the precise placement and location of the pupil with respect to the iris, and the light fusion prevents the two components from slipping with regard to one another, thereby producing a more accurate and reproducible representation of the natural eye.

Figure 11:
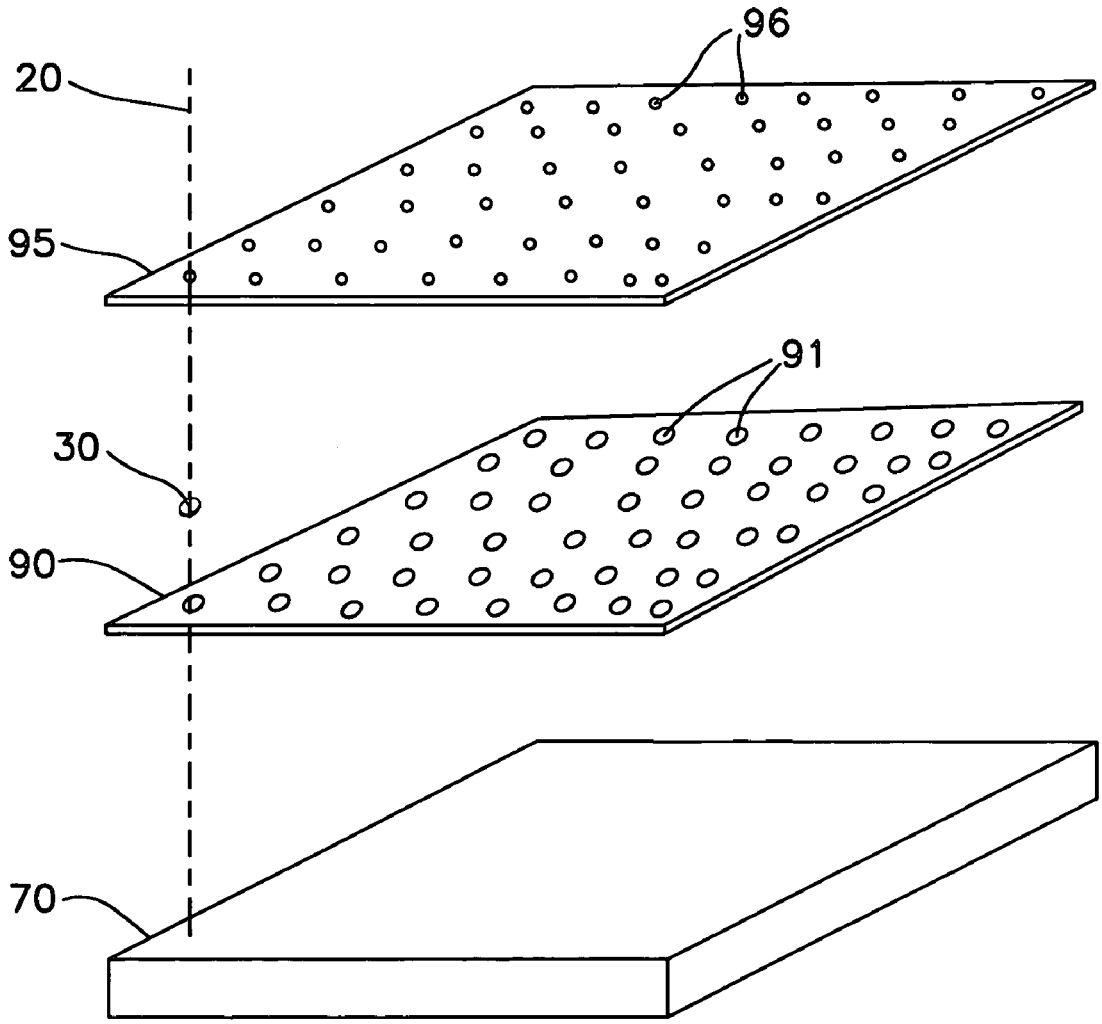
FIG. 11 shows an expanded view of an apparatus for fusing the iris and pupil components of the present invention.

As shown in FIG. 11, for clarity in describing this method, the alignment trays are identified in terms of the component they are intended to align, such as iris alignment tray 90 or pupil alignment tray 95, as will be seen below. Iris alignment tray 90, has one or more holes 91, each of which is shaped and sized to accommodate a specific iris component 30. In practice, iris alignment tray 90 is placed over a carrier tray 70. Iris component 30 is then placed in one of the one or more holes 91. A pupil alignment tray 95, having one or more holes 96 shaped and sized to accommodate a specific pupil component 20 is then placed over the iris alignment tray. Since in most eyes the pupil is smaller than the iris, in a preferred embodiment, holes 96 in pupil alignment tray are smaller than holes 91 in iris alignment tray. The position of pupil alignment tray 95 in relation to iris alignment tray 90, and the position of holes 96 in pupil alignment tray 95 in relation to holes 91 in iris alignment tray 90, allow for the proper positioning and placement of the pupil on the iris. Pupil component 20 is then loaded into pupil alignment tray 95. Both iris alignment tray 90 and pupil alignment tray 95 are then carefully removed to avoid any movement or misalignment of the pupil and iris. Carrier tray 70, containing the now assembled iris and pupil components of the eye, is then placed in a kiln or on the belt of a belt furnace. As known to those skilled in the art, the kiln or belt furnace must be properly configured for the production of glass eyes embodiments. The iris and pupil assembly is then heated just to the beginning of the softening temperature of the glass in a belt furnace or kiln or by heating with a flame or by other means known to one skilled in the art. The components are thus lightly fused by heating, albeit only momentarily. The pupil component 20 and iris component 30 are thus lightly fused together to form a combined iris/pupil component. In this exemplary process, pupil component 20 sticks to iris component 30 to form the combined iris/pupil component without deforming either component.

According to the foregoing, therefore, the present invention successfully provides a realistically accurate and reproducible artificial glass eye and novel methods for manufacturing such an artificial glass eye. While the foregoing specification has been described with regard to certain preferred embodiments, and many details have been set forth for the purpose of illustration, it will be apparent to those skilled in the art without departing from the spirit and scope of the invention, that the invention may be subject to various modifications and additional embodiments, and that certain of the details described herein can be varied considerably without departing from the basic principles of the invention. Such modifications and additional embodiments are also intended to fall within the scope of the appended claims.

What is claimed is:

1. An artificial glass eye comprising pre-formed glass components fused together, said components comprising a glass base component, a pupil component, an iris component, and a cornea component, wherein air is substantially prevented from being trapped between said components, and wherein said glass base component comprises a generally solid glass cylinder having a top end and a bottom end, and wherein said top end further comprises a recess.

2. An artificial glass eye comprising pre-formed glass components fused together, said components comprising a glass base component, a pupil component, an iris component, and a cornea component, wherein air is substantially prevented from being trapped between said components, and wherein said eye further comprises an outer ring component, wherein said outer ring component comprises a generally hollow cylindrical shape having an inner surface and an outer surface, and wherein said inner surface further comprises an inner area.

3. The artificial glass eye of claim 2, wherein said glass base component fits into said inner area of said outer ring component.

* * * * *